US010428462B2

(12) United States Patent
Närhi et al.

(10) Patent No.: US 10,428,462 B2
(45) Date of Patent: Oct. 1, 2019

(54) RELEASE PRODUCT

(75) Inventors: Anu Närhi, Kärjenniemi (FI); Jukka Kivivasara, Valkeakoski (FI)

(73) Assignee: UPM SPECIALTY PAPERS OY, Helsinki (FI)

( * ) Notice: Subject to any disclaimer, the term of this patent is extended or adjusted under 35 U.S.C. 154(b) by 234 days.

(21) Appl. No.: 12/664,693

(22) PCT Filed: Jun. 15, 2007

(86) PCT No.: PCT/FI2007/050363
§ 371 (c)(1),
(2), (4) Date: Jun. 9, 2010

(87) PCT Pub. No.: WO2008/152182
PCT Pub. Date: Dec. 18, 2008

(65) Prior Publication Data

US 2010/0261006 A1 Oct. 14, 2010

(51) Int. Cl.

| | |
|---|---|
| ***B23B 5/16*** | (2006.01) |
| ***B32B 9/04*** | (2006.01) |
| ***B32B 19/00*** | (2006.01) |
| ***D21H 27/00*** | (2006.01) |
| ***D21H 19/40*** | (2006.01) |
| ***D21H 19/52*** | (2006.01) |
| ***D21H 19/54*** | (2006.01) |
| ***D21H 19/82*** | (2006.01) |
| ***D21H 19/84*** | (2006.01) |

(52) U.S. Cl.
CPC ..... *D21H 27/001* (2013.01); *D21H 19/40* (2013.01); *D21H 19/52* (2013.01); *D21H 19/54* (2013.01); *D21H 19/82* (2013.01); *D21H 19/84* (2013.01); *Y10T 428/259* (2015.01)

(58) Field of Classification Search
USPC ..... 428/331
See application file for complete search history.

(56) References Cited

U.S. PATENT DOCUMENTS

| | | | | |
|---|---|---|---|---|
| 4,074,000 | A | 2/1978 | Hankee et al. | |
| 4,388,362 | A * | 6/1983 | Iwata et al. | 503/200 |
| 4,577,204 | A * | 3/1986 | Shibata | B41M 5/44 283/114 |
| 4,622,566 | A * | 11/1986 | Kasamatsu | B41M 5/3336 427/150 |
| 5,882,755 | A * | 3/1999 | Igarashi | B41M 5/502 428/32.1 |
| 6,849,242 | B1 * | 2/2005 | Koeppler | C01B 33/124 423/335 |
| 2003/0068473 | A1 * | 4/2003 | Okumura | B41M 5/52 428/195.1 |
| 2004/0062913 | A1 | 4/2004 | Suto et al. | |
| 2005/0182153 | A1 * | 8/2005 | Yokoi | C09D 7/70 523/122 |
| 2006/0231226 | A1 * | 10/2006 | Makinen | 162/135 |
| 2008/0103245 | A1 * | 5/2008 | Endo | C01B 33/1417 524/543 |
| 2010/0189993 | A1 * | 7/2010 | Mori et al. | 428/317.5 |

FOREIGN PATENT DOCUMENTS

| | | | |
|---|---|---|---|
| EP | 0 276 048 | A1 | 7/1988 |
| EP | 0 605 840 | A2 | 7/1994 |
| EP | 1072664 | * | 7/2000 |
| EP | 1 249 533 | A1 | 10/2002 |
| EP | 1323863 | A1 | 7/2003 |
| EP | 1721662 | * | 11/2006 |
| JP | 4234473 | A | 8/1992 |
| WO | WO-03078734 | A1 | 9/2003 |
| WO | WO2006/137560 | * | 12/2006 |

OTHER PUBLICATIONS

English Translation of Noguchi et al. (JP 2006-116797), May 2006.*
PCT/ISA/210—International Search Report—dated Feb. 28, 2008.
PCT/ISA/237—Written Opinion of the International Searching Authority—dated Feb. 28, 2008.
Supplementary European Search Report, issued in counterpart application EP 07 78 8748, dated May 3, 2011.
First Office Action, dated May 3, 2012, from the State Intellectual Property Office, P.R. China, issued in connection with counterpart Chinese Application No. 20078005335.5.

* cited by examiner

*Primary Examiner* — Ronak C Patel
(74) *Attorney, Agent, or Firm* — Cantor Colburn LLP

(57) ABSTRACT

A release product including a basic substrate and a siliconized release layer. The basic substrate has a first side and a second side. The siliconized release layer has been applied on the first side of the basic substrate. The release product includes a coating layer which has been applied directly on either the first side of the basic substrate, or the second side of the basic substrate. The coating layer includes silica particles and a binder.

6 Claims, No Drawings

RELEASE PRODUCT

CROSS-REFERENCE TO RELATED APPLICATIONS

This application is the national phase under 35 U.S.C. § 371 of PCT/FI2007/050363 filed 15 Jun. 2007.

FIELD OF THE INVENTION

The present invention relates to a release product comprising a basic substrate and a siliconized release layer. The basic substrate has a first side and a second side. The siliconized release layer has been applied on the first side of the basic substrate.

BACKGROUND OF THE INVENTION

A release product usually comprises a paper provided with a silicone coating. However, plastic material can also be used instead of paper. The release product is used as a backing paper for self-adhesive labels which are either paper, or plastic material. The release product and the face material attached to the release product form a self-adhesive laminate web. A problem related to this product is that the silicone coating tend to migrate through the basic substrate. During manufacturing, or after the laminate web is wound to a roll (the surface of the face material and the second side of the release product contact each other in the roll), the face material of the laminate web may be contaminated with silicone. This causes problems e.g. in printing, or with metallised layers. In order to avoid such problems, the release product of the invention has been developed.

SUMMARY OF THE INVENTION

The release product is characterized in that the release product comprises a coating layer which has been applied directly on either the first side of the release product, or on the second side of the release product, the coating layer comprising silica particles and a binder.

The coating layer absorbs the problematic silicone before it causes harmful effects. Thus, printing problems are avoided.

DETAILED DESCRIPTION Of Embodiments Of The Invention

The coating layer comprises inorganic particles and a binder. The inorganic particles contain silica ($SiO_2$) particles. The silica particles may be a silica gel, a colloidal silica, a precipitated silica, or a fumed silica. The silica gel is a highly absorbent form of silicon dioxide. Instead, or in addition to silica particles it is possible to use aluminium hydroxide particles ($Al(OH)_3$).

The preferred silica particles are porous amorphous silicic anhydride particles, i.e. silica gel. The particles may have an average particle size from 0.3 to 20 μm, preferably from 0.3 to 10 μm, more preferably the average particle size is from 0.3 to 8 μm. The surface area may be at least 200 $m^2/g$, preferably at least 300 $m^2/g$, and the bulk density at least 0.15 $g/cm^3$, preferably at least 0.30 $g/cm^3$. For example, a product having an average particle size of 4 μm, a surface area of 340 $m^2/g$ and a bulk density of 1.77 $g/cm^3$ was well suitable for this purpose.

The binder forms a medium to the silica particles. The binder preferably comprises natural polymers or their derivatives, such as starch, carboxymethyl cellulose (CMC), or mixtures of those. Starch is rather cheap material to be used whereas CMC makes the runnability of the coating line better.

In addition to the silica particles, the coating composition may comprise other inorganic particles, such as kaolin or talc, to add impermeability to the coating layer. The coating composition may also comprise a medium which brings impermeability to the coating layer for its part. Such a medium may be e.g. polyvinyl alcohol, or styrene/butadiene copolymer.

Further, the coating composition may comprise a cross-linking agent whose amount is relative to the total amount of the binder comprising the natural polymers and their derivatives. The purpose of the cross-linking agent in the coating composition is to prevent dusting and sticking to calender rolls.

The coating layer is applied directly on the basic substrate, i.e. there is not e.g. plastic layers between the basic substrate, i.e. the base paper or another suitable base material, and the coating layer. However, there may be surface sizing layers, or other coated layers between the basic substrate and the coating layer. The coating layer is usually a one layer coating, but a multilayer coating is also possible.

The base paper may be a glassine paper, or a calendered paper. A silicone layer is applied on the first side of the paper and cured. The coating layer is applied to the second side of the release paper by methods which are known as such, for example blade coating, airbrush coating, curtain coating, or coating in a film or size press. The coating may also be applied on the first side of the release paper under the silicone coating, i.e. between the silicone layer and the basic substrate. Preferably, however, the coating is applied on the second side of the release paper. The grammage of the coating layer may be from 0.7 to 1.4 $g/m^2$.

When the basic substrate is different from paper, all the above described facts can also be applied in connection with such basic substrate.

In the following, the invention will be described by means of an example.

EXAMPLE

Release papers were coated by using the coating recipes listed in table 1. The typical composition of the coating composition comprises at least silica particles and a binder comprising starch or its derivatives, cmc, or their mixtures. There is usually also a cross-linking agent in order to prevent dusting and sticking to calender rolls. The coating composition may also comprise inorganic particles different from the silica particles, such as kaolin.

TABLE 1

Coating compositions.

| | | Samples | | | | | |
|---|---|---|---|---|---|---|---|
| Typical composition | Specific composition | 1 | 2 | 3 | 4 | 5 | 6 |
| Starch | Raisamyl 21221 | 65 | 65 | 72 | 76 | 76 | 91 |
| Cross-linking agent | BIM SU-6040 | 3 | 3 | 3 | 4 | 4 | 4 |
| CMC | CP Kelco FF-801 | 2 | 2 | — | — | — | — |
| PVA | KSE Moviol 10-98 | 10 | 10 | 5 | 5 | 5 | — |
| Clay | Imerys ND 9321 | 10 | 15 | 10 | 10 | 10 | — |
| Silica | Formapol FP348 | 10 | 5 | 10 | 5 | 5 | 5 |

The numbers in the table are weight percents of the total amount (=100 wt.-%). The base paper was a glassine paper having a grammage of 64 g/m$^2$. The grammage of the coating layer was 1.1 g/m$^2$.

The used silica particles had an average particle size of about 4 μm, a surface area of about 340 m$^2$/g, and a bulk density of about 1.77 g/cm$^3$.

The coating compositions were applied on the second side of the release paper. All the coating layers showed desired properties, i.e. the coating layers were efficient to absorb contaminants.

The invention claimed is:

1. A release product for self-adhesive labels, consisting of:

a glassine paper comprising a first side and a second side, a silicone coating applied only on the first side of the glassine paper, and a coating layer which has been applied directly on only the second side of the glassine paper, the coating layer comprising porous silica particles, a cross-linking agent and a binder, wherein the release product is structured to be removable from a self-adhesive label, and wherein the porous silica particles have an average diameter of 0.3 to 10 μm, a surface area of at least 300 m$^2$/g and a bulk density of at least 0.15 g/cm$^3$.

2. The release product according to claim 1, wherein the binder comprises natural polymers or their derivatives.

3. The release product according to claim 2, wherein the binder comprises starch, carboxymethyl cellulose, or their mixture.

4. The release product according to claim 1, wherein the coating layer comprises kaolin or talc.

5. The release product according to claim 1, wherein the silica particles have a bulk density of at least 0.30 g/cm$^3$.

6. A release product for self-adhesive labels, consisting of:

a glassine paper comprising a first side and a second side, a silicone coating as a release layer applied on the first side of the glassine paper, and a coating layer which has been applied directly on the second side of the glassine paper, the coating layer comprising porous silica particles, a cross-linking agent and a binder;

wherein the release product is structured to be removable from a self-adhesive label, and wherein the porous silica particles have an average diameter of 0.3 to 10 μm, a surface area of at least 300 m$^2$/g and a bulk density of at least 0.15 g/cm$^3$.

* * * * *